US006008595A

United States Patent [19]

Fink et al.

[11] Patent Number: 6,008,595

[45] Date of Patent: Dec. 28, 1999

[54] FIELD EMISSION LAMP STRUCTURES

[75] Inventors: Richard Lee Fink; Nalin Kumar; Donald Miller Wilson, all of Austin, Tex.

[73] Assignee: SI Diamond Technology, Inc., Austin, Tex.

[21] Appl. No.: 08/845,129

[22] Filed: Apr. 21, 1997

[51] Int. Cl.[6] ..... G05F 1/00

[52] U.S. Cl. ..... 315/308; 313/306; 313/308; 313/309; 313/310; 313/336; 313/351; 313/495-7

[58] Field of Search ..... 313/306, 308, 313/309, 310, 336, 351, 495, 496, 497

[56] References Cited

U.S. PATENT DOCUMENTS 3,671,798 6/1972 Lees ..... 313/336

*Primary Examiner*—Ashok Patel

*Attorney, Agent, or Firm*—Kelly K. Kordzik; Winstead Sechrest & Minick P.C.

[57] ABSTRACT

A field emission lamp, of either a diode or triode structure has a packaging whereby electrical access to the various electrodes of the lamp is provided through the rear or underside of the field emission device so that the individual lamps can be placed in close proximity to each other.

36 Claims, 7 Drawing Sheets

FIELD EMISSION LAMP STRUCTURES

TECHNICAL FIELD

The present invention relates in general to field emission devices, and in particular, to a field emission lamp.

BACKGROUND INFORMATION

To date, display panels using field emission technology have utilized a configuration where the individual pixels of the display are addressed in a matrix-addressable manner using crisscrossing rows and columns of electrodes in order to individually activate the pixels. External access to these electrodes has been provided from the sides of the display device where driver electronics are coupled in order to drive the individual pixels.

A relatively new application for field emission devices is to produce a large display having pixels each comprised of individually packaged field emission devices. Such a configuration can produce a "billboard-type" display for use in such applications as road-side billboards and display screens within sports arenas.

One problem encountered has been that the traditional configuration for field emission displays whereby electrical access to the individual pixels is provided from the sides of the display makes it difficult to assemble the individual lamps in close proximity to each other, which would provide a higher quality displayed image.

Therefore, there is a need in the art for a field emission lamp that alleviates this problem.

SUMMARY OF THE INVENTION

The present invention addresses the foregoing need by providing a field emission lamp structure (cathode, grid, anode) whereby electrical access to the individual components of the lamp structure, such as the cathode, anode, and grid (optional), is provided through the underneath portion of the lamp structure and not from the sides. As a result, the individual lamps can be packaged close together since all of their electrical leads emanate from the underside or rear of the lamps.

Such a field emission lamp can be configured in a diode or triode manner. Furthermore, a lamp may display a single color, or a plurality of colors, each of which can be individually activated by the driving circuitry.

A display comprising a plurality of these lamps can be driven by a data processing system in much the same manner as the individual colored pixels of a cathode ray tube (CRT) are driven on a desktop computer.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
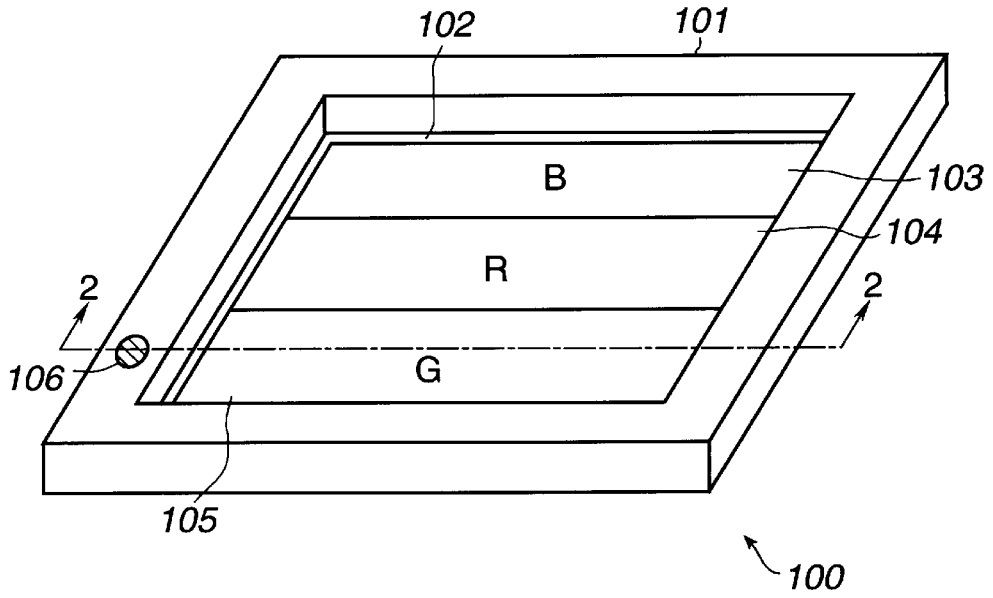
FIG. 1 illustrates an isometric view of a cathode in accordance with one embodiment of the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Refer now to the drawings wherein depicted elements are not necessarily shown to scale and wherein like or similar elements are designated by the same reference numeral through the several views.

Please note that the pixel of the present invention may take on any one of a number of shapes such as a square, circle, or any polygon shape. The various following figures assist in illustrating some of these embodiments. One of the advantages of the present invention is that since electrical contacts for accessing the various electrodes of the field emission devices emanate from the rear of the individual lamps, the lamps may be butted together on all sides in close proximity to each other as illustrated in one example in FIG. 19.

Figure 2:
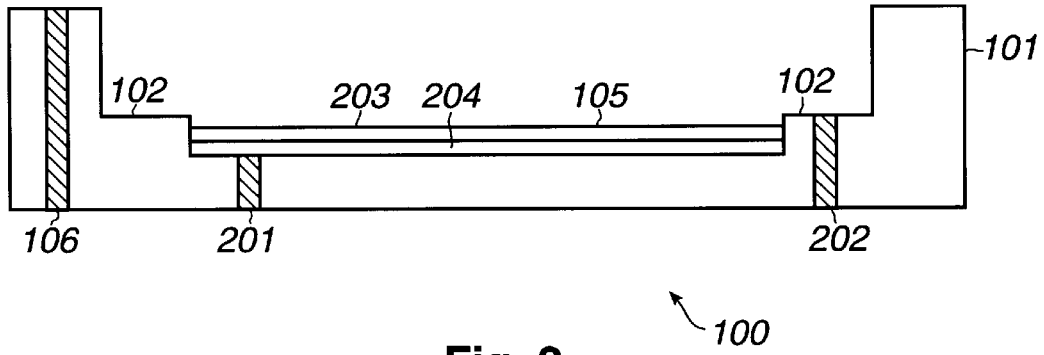
FIG. 2 illustrates a sectional view of the cathode illustrated in FIG. 1.
Figure 6:
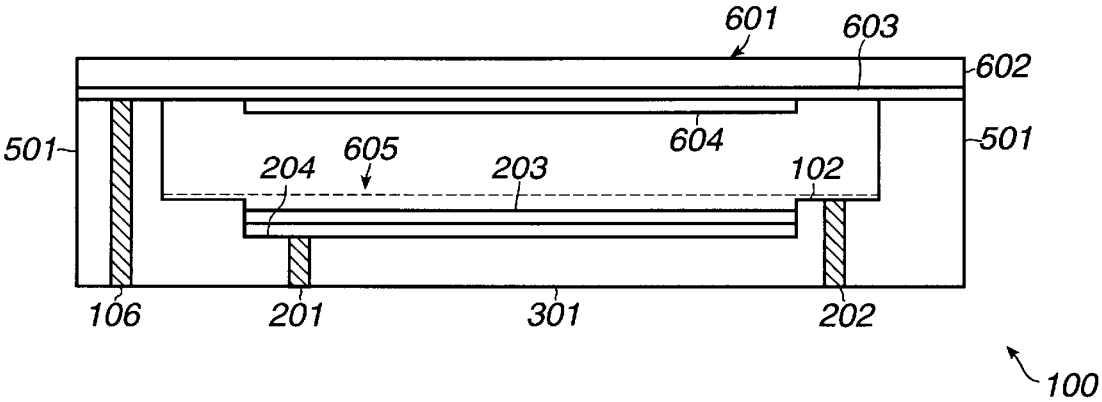
FIG. 6 illustrates a triode lamp in accordance with one embodiment of the present invention.

Referring to FIGS. 1 and 2, there is illustrated cathode 100 comprising multilayer ceramic package 101. Multilayer ceramic package 101 allows for a very small package height with very good ability to hold the tolerances implemented. The ceramic packaging also allows for an easy connection to the back of the lamp, and any metal to ceramic bonds are very good for welding or bonding. Cathode 100 shows pixels 103–105 designated for displaying blue (B), red (R), and green (G) colors. Deposited within package 101 is metallic material 204 such as molybdenum, and then emitter material 203 deposited on layer 204. Emitter material 203 may be any well-known field emitter material, such as CVD diamond or amorphic diamond. Package 101 also includes shelf 102 around its periphery, which as described further below with respect to FIG. 6, is adaptable for positioning a grid layer over cathode 105. The use of a grid layer is well-known in the field emission art.

Electrical access to layer 204 is provided through feedthrough 201, which comprises some type of conducting material. Access to the grid (not shown) is provided through feedthrough 202. Feedthrough 106 provides access to an anode layer (see FIG. 6).

Figure 3:
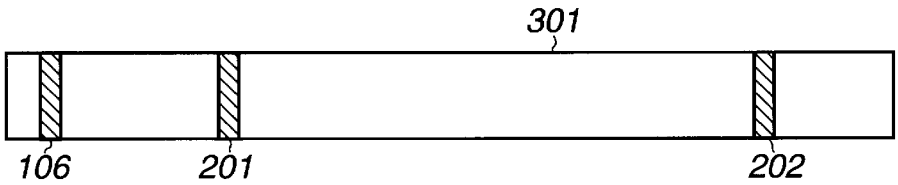
FIGS. 3–5 illustrate various manufacturing stages for producing a cathode in accordance with the present invention.
Figure 4:
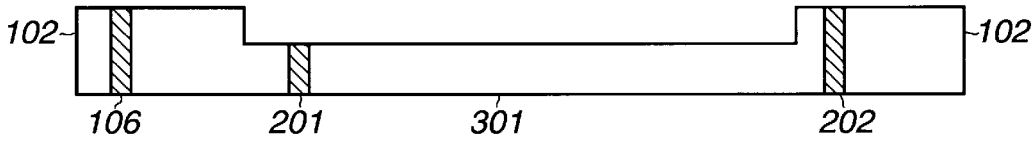
Figure 5:
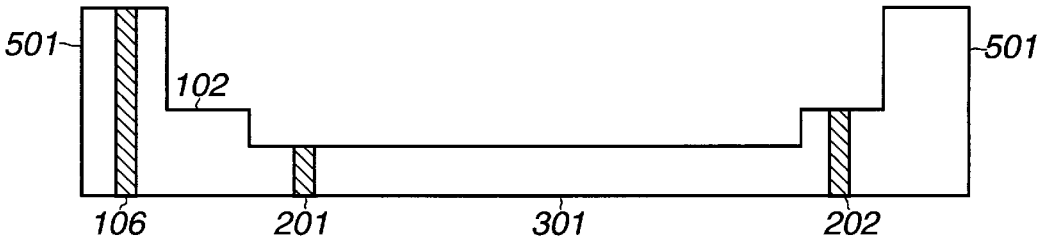

Referring next to FIGS. 3–5, there is illustrated a process for manufacturing cathode 100. In FIG. 3, substrate layer 301 is manufactured with feedthroughs 106, 201, and 202 therethrough at desired locations. Substrate 301 may be a ceramic-like material or some other type of insulating structure, such as glass, fosterite, or alumina with metal feedthroughs 106, 201, and 202. If substrate 301 is made of a ceramic, or ceramic-like material, then it may be cast or doctor bladed. The feedthroughs may be punched in and filled with a metal paste.

Referring next to FIG. 4, a second layer 102 of ceramic with feedthroughs is then bonded with substrate 301 in order to produce shelf 102. Note that metal feedthroughs 106 and 202 are built upon with this second layer. The second layer 102 is manufactured in much the same way as substrate 301. When the second layer 102 is placed upon substrate 301 it is bonded with substrate 301 through a pressing process and then fired.

Referring next to FIG. 5, a third layer 501 is applied and then bonded with the second layer. Again, feedthrough 106 is continued with this third layer. This third layer 501 will operate to provide a support for anode 601 illustrated in FIG. 6. Anode 601 includes glass substrate 602 with ITO layer 603 deposited thereon and phosphor layer 604 on ITO layer 603. Feedthrough 106 provides electrical access to ITO layer 603 from the bottom of cathode 100.

FIG. 6 also shows that conducting layer 204 and diamond layer 203 have been deposited thereon to complete cathode 100. Additionally, grid 605 has been bonded to shelf 102. To hold grid 605 tight during operation, the ceramic cathode substrate 101 could be chilled or frozen with grid 605 at room temperature, then welded in place. As the ceramic material warms up, the ceramic substrate 101 will expand to hold grid 605 in tension.

Feedthrough 202 provides electrical access to grid 605 from the bottom of cathode 100.

Figure 7:
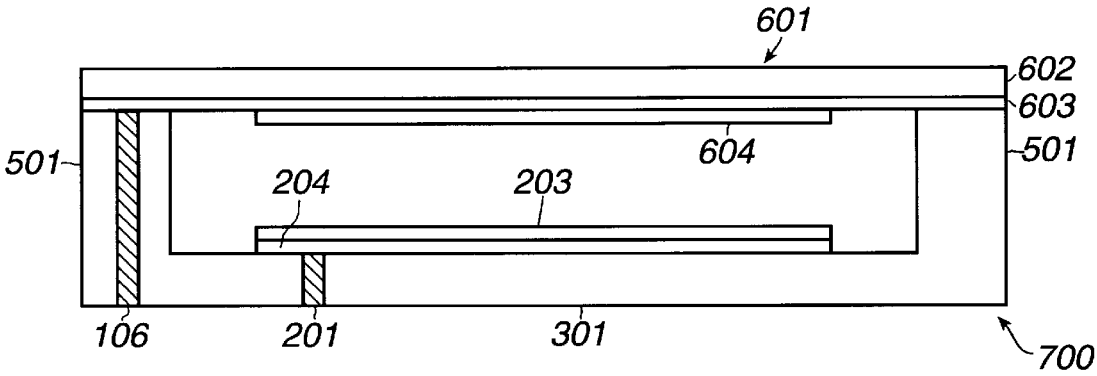
FIG. 7 illustrates a diode lamp in accordance with one embodiment of the present invention.

Referring next to FIG. 7, there is illustrated a diode lamp comprised of anode 601 and cathode 700, which is similar to cathode 100, except that shelf 102 and grid 605 are not implemented in this design.

Figure 8:
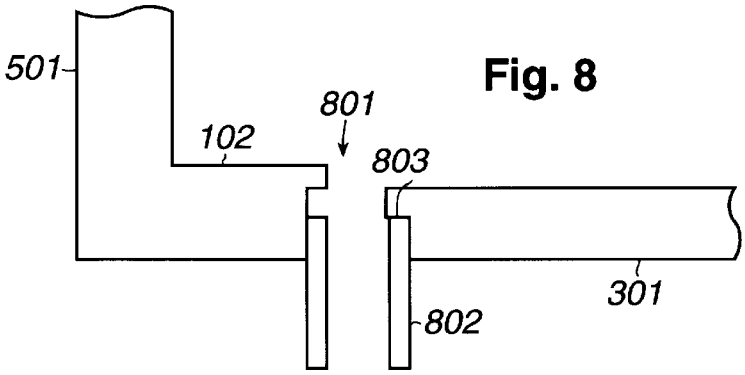
FIGS. 8 and 9 illustrate two possible embodiments for providing a getter into a lamp.

Referring next to FIG. 8, there is illustrated an alternative embodiment of the present invention where cathode 100 has hole 801 drilled therethrough so that metal or glass tube 802 can be inserted to provide a getter material. Note that in this configuration, tube 802 may be inserted up to ledge 803.

Figure 9:
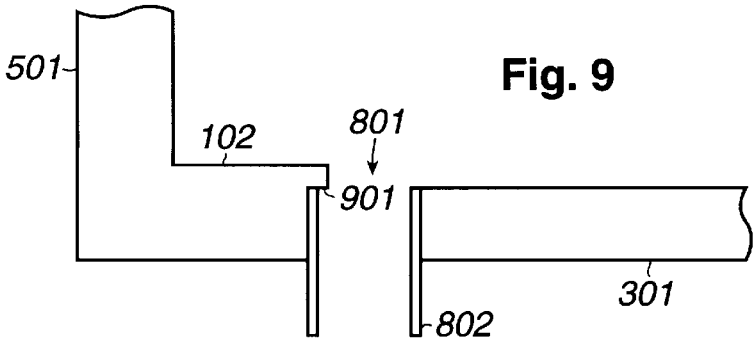

FIG. 9 illustrates tube 802 also inserted into substrate 301, but in this instance up to ledge 901 underneath shelf 102.

Referring next to FIGS. 10–17, there are illustrated various pixel configurations for a lamp of the present invention.

Figure 10:
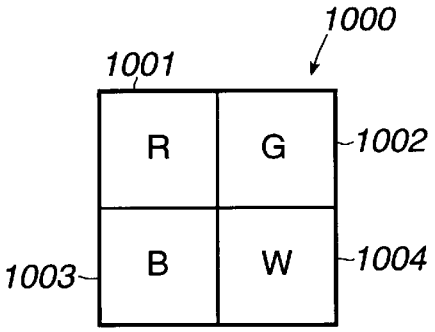
FIGS. 10–17 illustrate various possible embodiments for providing colored pixels using the lamp of the present invention.

FIG. 10 illustrates configuration 1000, which includes equally sized red (R), green (G), blue (B), and white (W) pixels 1001–1004, respectively, which could be implemented within cathode 100.

Figure 11:
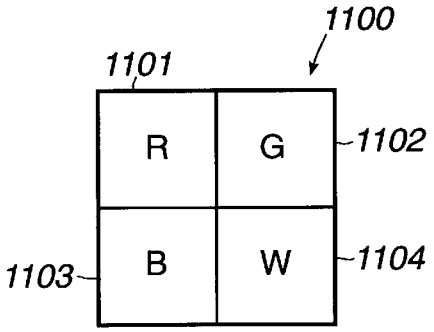

FIG. 11 illustrates pixel configuration 1100 whereby green pixel 1102 and white pixel 1104 are of a smaller area than red pixel 1101 and blue pixel 1103.

Note, feedthroughs through structure 101 can be added in order to provide individual access to each one of the colored pixels, such as shown in FIGS. 2–7 for one pixel, which in FIGS. 1 and 2 is green pixel 105.

Figure 12:
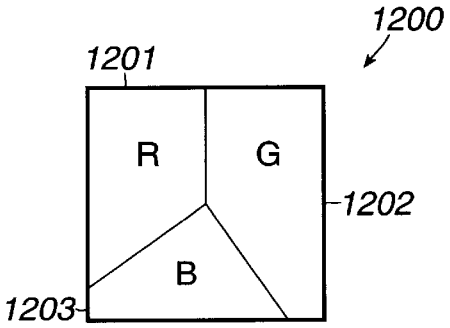

FIG. 12 shows configuration 1200 comprising only red 1201, green 1202, and blue 1203 pixels.

Figure 13:
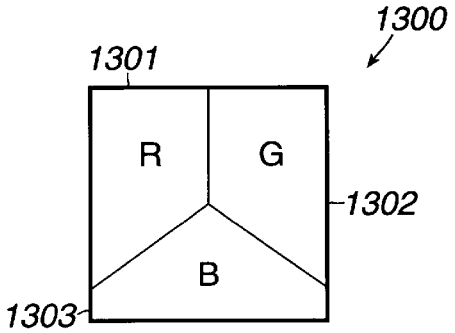

FIG. 13 illustrates configuration 1300 which is similar to configuration 1200 except that blue pixel 1303 is in more equal proportion to red pixel 1301 and green pixel 1302.

Figure 14:
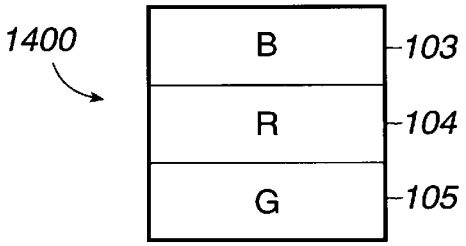

FIG. 14 illustrates configuration 1400 which corresponds to the pixel configuration illustrated in FIG. 1.

Figure 15:
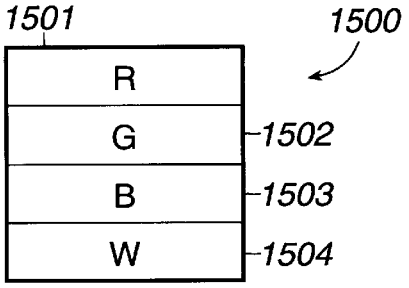

FIG. 15 illustrates configuration 1500 which is similar to configuration 1400 except that white pixel 1504 has been added to red pixel 1501, green pixel 1502, and blue pixel 1503.

Figure 16:
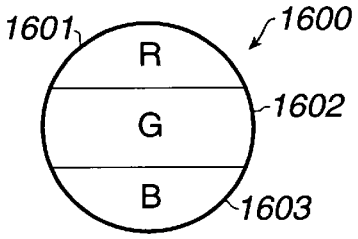
Figure 17:
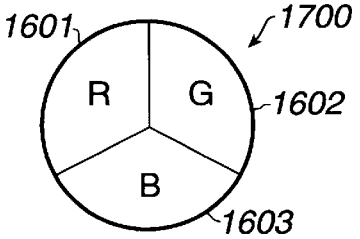

FIGS. 16 and 17 illustrate round configurations 1600 and 1700, respectively. Configuration 1600 includes red 1601, green 1602, and blue 1603 pixels, while configuration 1700 illustrates the same pixels in a different geometric configuration.

Figure 18:
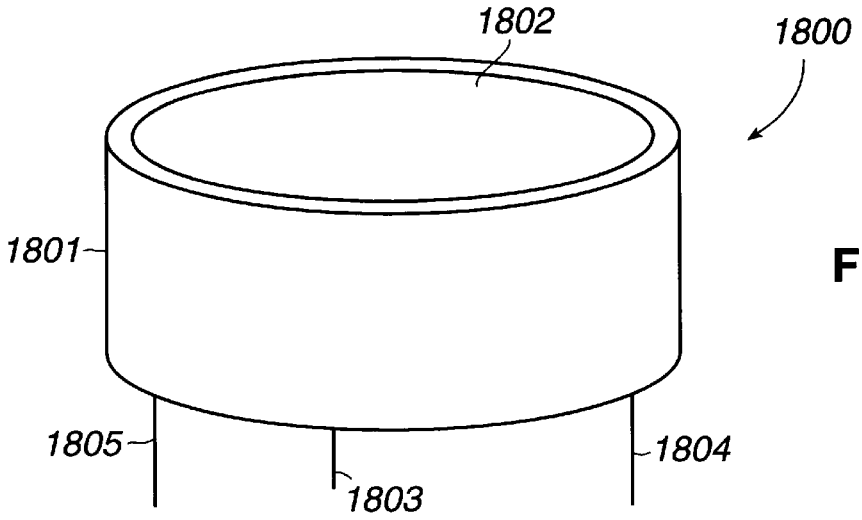
FIG. 18 illustrates an isometric view of a lamp.

Referring next to FIG. 18, there is illustrated an external view of lamp 1800 in accordance with the present invention. Shell 1801 corresponds to structure 101 shown in FIG. 1. Note that some type of protective covering may be formed onto structure 1801. Lamp 1800 includes pixel 1802, which may be comprised of one or more colored pixels, such as those illustrated herein. Electrical access to lamp 1800 is provided through electrical leads 1803–1805, which emanate from the rear or underside of lamp 1800. As an example, lead 1805 may provide access to feedthrough 106, which accesses anode 601, while feedthrough 1803 provides access to layer 204 through cathode 100. Likewise, electrical connection 1804 may provide electrical access to grid 605 through feedthrough 202.

Figure 19:
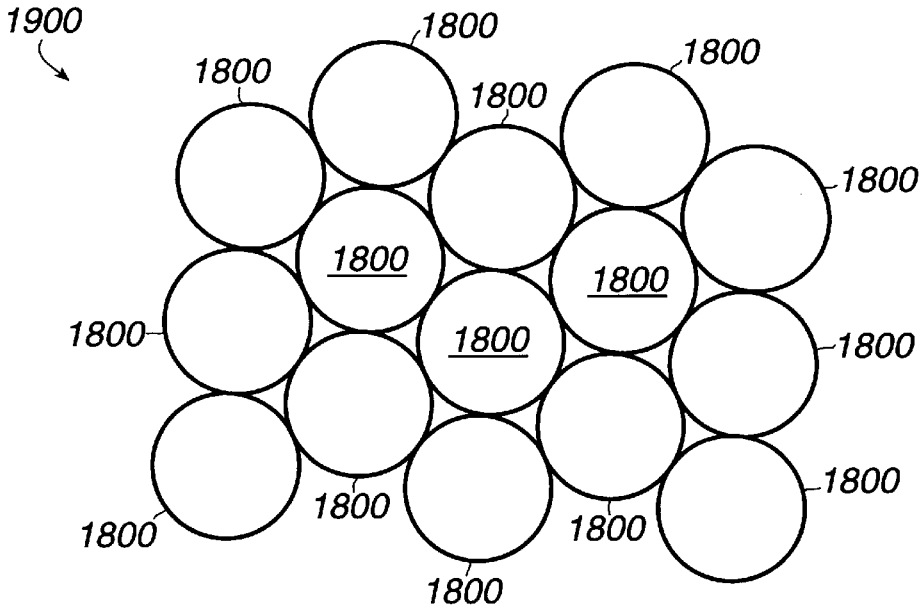
FIG. 19 illustrates a portion of a display implementing the lamps of the present invention.

FIG. 19 illustrates portion 1900 of a display comprised of a plurality of lamps 1800. Portion 1900 illustrates how providing electrical access to the underside of each of lamps 1800 allows for the packaging of lamps 1800 in very close proximity to each other.

Figure 20:
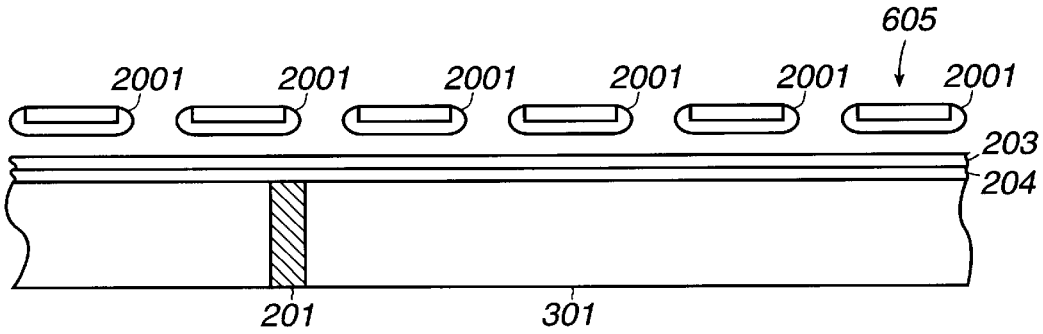
FIGS. 20 and 21 illustrate an implementation of a second electron emitter within a field emission device.

Referring next to FIG. 20, there is illustrated the depositing of a secondary electron emitter material 2001 onto each of grid portion 605.

Typically, a grid structure is either metal, or coated with silicon dioxide or other insulator on the bottom. If the grid structure is coated with metal, it will take up much of the electrons that are emitted from the cathode. Coating the bottom side of the grid with silicon dioxide or another insulator may prevent the electrons from hitting the grid conducting layer, but it also may lead to charge build-up, which could cause arcing or break-down discharging and may lead to inefficient operating conditions.

To alleviate this problem, coating 2001 is applied to the grid structure (or at least the sides facing the cold cathode) with a magnesium oxide (MgO) material or some other high secondary electron emitter material. This has a number of advantages, one of which is that it may provide a diffuse source of electrons for striking the anode. A second advantage is that it may add to the emission current and not subtract from it.

Figure 21:
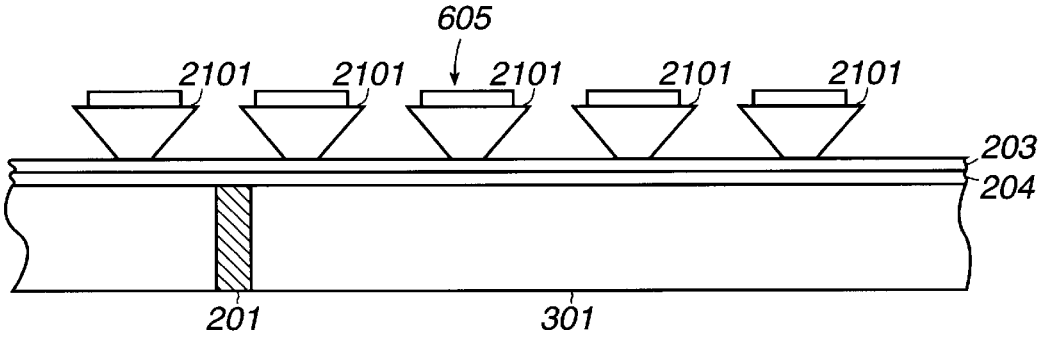

Referring next to FIG. 21, there is illustrated an alternative embodiment of this feature where the grid 605 is applied onto pedestals 2101 of the secondary electron emitter material.

Figure 22:
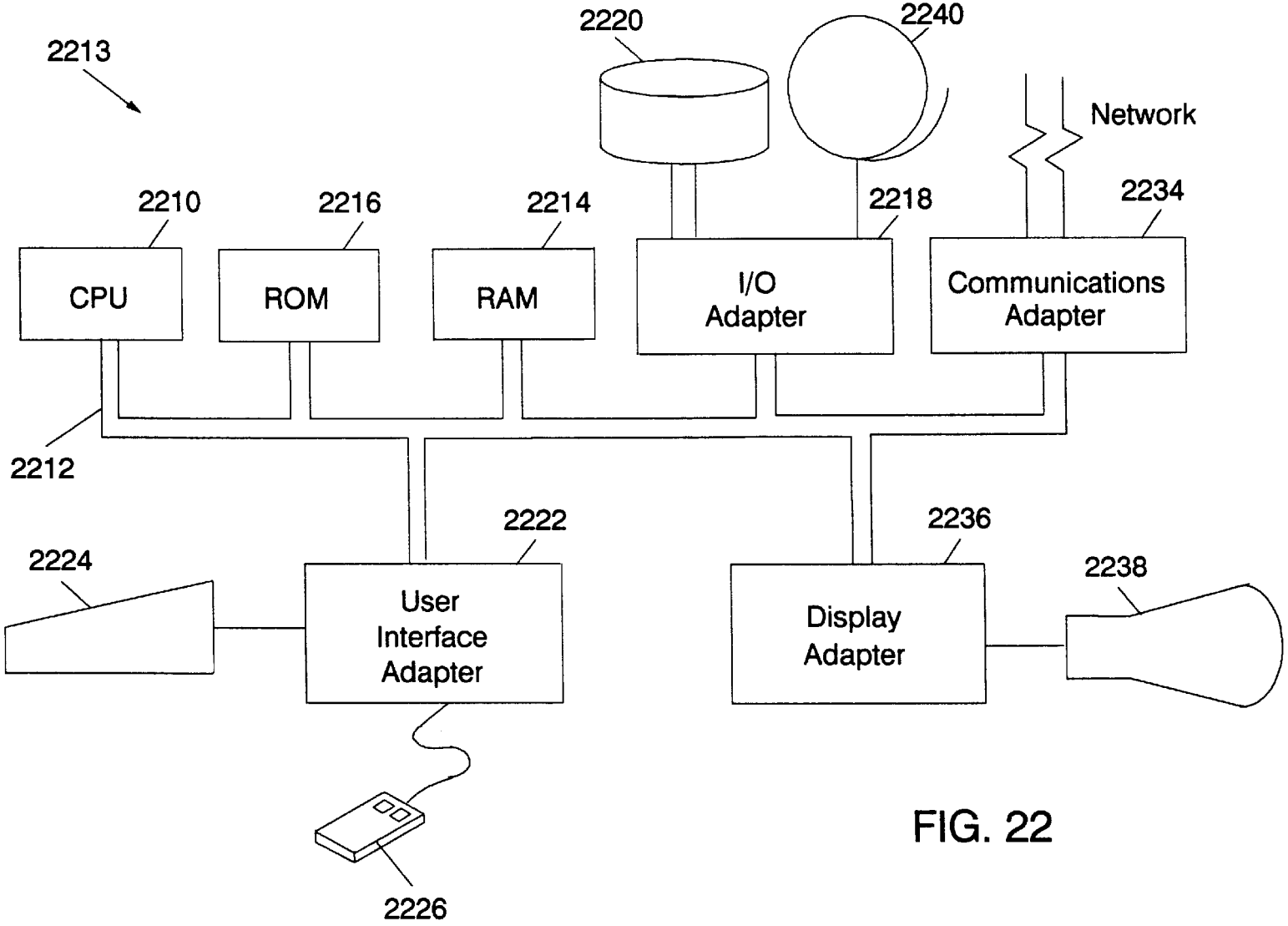
FIG. 22 illustrates a data processing system operable for driving any one of the embodiments of the present invention.

A representative hardware environment for practicing the present invention is depicted in FIG. 22, which illustrates a typical hardware configuration of workstation 2213 in accordance with the subject invention having central processing unit (CPU) 2210, such as a conventional microprocessor, and a number of other units interconnected via system bus 2212. Workstation 2213 shown in FIG. 22 includes random access memory (RAM) 2214, read only memory (ROM)

2216, and input/output (I/O) adapter 2218 for connecting peripheral devices such as disk units 2220 and tape drives 2240 to bus 2212, user interface adapter 2222 for connecting keyboard 2224, mouse 2260, and/or other user interface devices such as a touch screen device (not shown) to bus 2212, communication adapter 2234 for connecting workstation 2213 to data processing (or telecommunications) network 2261, and display adapter 2236 for connecting bus 2212 to display device 2238. CPU 2210 may include other circuitry not shown herein, which will include circuitry commonly found within a microprocessor, e.g., execution unit, bus interface unit, arithmetic logic unit, etc.

System 2213 may be configured to operate display 2238, which may comprise field emission pixel lamps as described herein, such as by utilizing a display comprising lamps 1800 in a configuration as shown in FIG. 19. The driving of the individual lamps, and even the colored pixels within each lamp, can be performed by display adapter 2236 in a well-known manner, and as similarly done with respect to matrix-addressable field emission display panels.

Although the present invention and its advantages have been described in detail, it should be understood that various changes, substitutions and alterations can be made herein without departing from the spirit and scope of the invention as defined by the appended claims.

What is claimed is:

1. A field emission cathode assembly, comprising:

a substrate having a topside and an underside;

an electron emitter deposited on said topside of said substrate, wherein said electron emitter includes an electrical conductor deposited on said topside of said substrate and an emitter material deposited on said electrical conductor; and a first electrically conducting feedthrough passing through said substrate in a manner so that a first end of said feedthrough is accessible on said topside and a second end of said first feedthrough is accessible on said underside, wherein said first feedthrough is coupled to said electron emitter.

2. The cathode assembly as recited in claim 1, wherein said emitter material is diamond.

3. The cathode assembly as recited in claim 1, wherein said emitter material is amorphic diamond comprising $SP^2$ and $SP^3$ crystallites.

4. The cathode assembly as recited in claim 3, wherein said emitter material is relatively flat.

5. The cathode assembly as recited in claim 1, wherein said emitter material is carbon.

6. The cathode assembly as recited in claim 1, wherein said substrate is a ceramic, glass or ceramic-like material.

7. A field emission cathode assembly, comprising:

a substrate having a topside and an underside:

an electron emitter deposited on said topside of said substrate;

a first electrically conducting feedthrough passing through said substrate in a manner so that a first end of said feedthrough is accessible on said topside and a second end of said first feedthrough is accessible on said underside, wherein said first feedthrough is coupled to said electron emitter; and a shelf structure adaptable for positioning a grid over said electron emitter.

8. The cathode assembly as recited in claim 7, further comprising a second electrically conducting feedthrough passing through said substrate and said shelf structure in a manner so that a first end of said second feedthrough is accessible on a topside of said shelf structure and a second end of said second feedthrough is accessible on said underside of said substrate, wherein said second feedthrough is adaptable for coupling to said grid.

9. The cathode assembly as recited in claim 8, further comprising a divider structure adaptable for positioning an anode assembly over said electron emitter.

10. The cathode assembly as recited in claim 9, further comprising a third electrically conducting feedthrough passing through said substrate and said divider structure in a manner so that a first end of said third feedthrough is accessible on a topside of said divider structure and a second end of said third feedthrough is accessible on said underside of said substrate, wherein said third feedthrough is adaptable for coupling to said anode assembly.

11. A field emission cathode assembly, comprising:

a substrate having a topside and an underside;

an electron emitter deposited on said topside of said substrate;

a first electrically conducting feedthrough passing through said substrate in a manner so that a first end of said feedthrough is accessible on said topside and a second end of said first feedthrough is accessible on said underside, wherein said first feedthrough is coupled to said electron emitter; and a divider structure adaptable for positioning an anode assembly over said electron emitter.

12. The cathode assembly as recited in claim 11, further comprising a second electrically conducting feedthrough passing through said substrate and said divider structure in a manner so that a first end of said second feedthrough is accessible on a topside of said divider structure and a second end of said second feedthrough is accessible on said underside of said substrate, wherein said second feedthrough is adaptable for coupling to said anode assembly.

13. A field emission lamp, comprising:

an anode assembly, comprising:

a substrate;

an electrically conducting layer deposited on said substrate;

a phosphor deposited on said electrically conducting layer; and a cathode assembly, comprising:

a substrate having a topside and an underside;

an electron emitter deposited on said topside of said substrate, wherein said electron emitter includes an electrical conductor deposited on said topside of said substrate and an emitter material deposited on said electrical conductor;

a first electrically conducting feedthrough passing through said substrate in a manner so that a first end of said first feedthrough is accessible on said topside and a second end of said first feedthrough is accessible on said underside, wherein said first feedthrough is coupled to said electron emitter; and a divider structure adaptable for positioning said anode assembly over said cathode assembly.

14. The lamp as recited in claim 13, wherein said substrate is a ceramic, glass or ceramic-like material.

15. The lamp as recited in claim 13, wherein said lamp includes one or more colored pixels each individually addressable.

16. A field emission lamp, comprising:

an anode assembly, comprising:

a substrate;

an electrically conducting layer deposited on said substrate;

a phosphor deposited on said electrically conducting layer; and a cathode assembly, comprising:

a substrate having a topside and an underside;

an electron emitter deposited on said topside of said substrate;

a first electrically conducting feedthrough passing through said substrate in a manner so that a first end of said first feedthrough is accessible on said topside and a second end of said first feedthrough is accessible on said underside, wherein said first feedthrough is coupled to said electron emitter;

a divider structure adaptable for positioning said anode assembly over said cathode assembly; and a shelf structure adaptable for positioning a grid over said electron emitter.

17. The lamp as recited in claim 16, further comprising a second electrically conducting feedthrough passing through said substrate and said shelf structure in a manner so that a first end of said second feedthrough is accessible on a topside of said shelf structure and a second end of said second feedthrough is accessible on said underside of said substrate, wherein said second feedthrough is adaptable for coupling to said grid.

18. The lamp as recited in claim 16, further comprising a secondary electron emitter material deposited on said grid.

19. The lamp as recited in claim 18, wherein said secondary electron emitter material contacts both said grid and said electron emitter.

20. A field emission lamp, comprising:

an anode assembly, comprising:

a substrate;

an electrically conducting layer deposited on said substrate;

a phosphor deposited on said electrically conducting layer; and a cathode assembly, comprising:

a substrate having a topside and an underside;

an electron emitter deposited on said topside of said substrate;

a first electrically conducting feedthrough passing through said substrate in a manner so that a first end of said first feedthrough is accessible on said topside and a second end of said first feedthrough is accessible on said underside, wherein said first feedthrough is coupled to said electron emitter;

a divider structure adaptable for positioning said anode assembly over said cathode assembly; and a second electrically conducting feedthrough passing through said substrate and said divider structure in a manner so that a first end of said second feedthrough is accessible on a topside of said divider structure and a second end of said second feedthrough is accessible on said underside of said substrate, wherein said second feedthrough is adaptable for coupling to said anode assembly.

21. The lamp as recited in claim 20, further comprising:

a shelf structure adaptable for positioning a grid over said electron emitter; and a third electrically conducting feedthrough passing through said substrate and said shelf structure in a manner so that a first end of said third feedthrough is accessible on a topside of said shelf structure and a third end of said third feedthrough is accessible on said underside of said substrate, wherein said third feedthrough is adaptable for coupling to said grid.

22. The lamp as recited in claim 21, further comprising first, second, and third conductors coupled to said first, second, and third feedthroughs, respectively, wherein said conductors are adaptable for coupling to a display adaptor, which is operable for driving said electron emitter, said grid, and said anode assembly with appropriate voltages in order to emit light from the lamp.

23. A display comprising a plurality of field emission lamps, wherein each one of said plurality of field emission lamps comprises:

a cathode assembly, comprising:

a substrate having a topside and an underside;

an electron emitter deposited on said topside of said substrate; and a first electrically conducting feedthrough passing through said substrate in a manner so that a first end of said first feedthrough is accessible on said topside and a second end of said first feedthrough is accessible on said underside, wherein said first feedthrough is coupled to said electron emitter, wherein said electron emitter includes an electrical conductor deposited on said topside of said substrate and an emitter material deposited on said electrical conductor.

24. The display as recited in claim 23, wherein said emitter material is diamond.

25. The display as recited in claim 24, wherein said emitter material is relatively flat.

26. The display as recited in claim 23, wherein said emitter material is amorphic diamond comprising $SP^2$ and $SP^3$ crystallites.

27. The display as recited in claim 23, wherein said emitter material comprises microtips.

28. The display as recited in claim 23, further comprising a divider structure for positioning an anode assembly over said electron emitter.

29. A display comprising a plurality of field emission lamps, wherein each one of said plurality of field emission lamps comprises:

a cathode assembly, comprising:

a substrate having a topside and an underside;

an electron emitter deposited on said topside of said substrate;

a first electrically conducting feedthrough passing through said substrate in a manner so that a first end of said first feedthrough is accessible on said topside and a second end of said first feedthrough is accessible on said underside, wherein said first feedthrough is coupled to said electron emitter;

a divider structure for positioning an anode assembly over said electron emitter; and a second electrically conducting feedthrough passing through said substrate and said divider structure in a manner so that a first end of said second feedthrough is accessible on a topside of said divider structure and a second end of said second feedthrough is accessible on said underside of said substrate, wherein said second feedthrough couples to said anode assembly.

30. The display as recited in claim 23, wherein said substrate is a ceramic or ceramic-like material.

31. A display comprising a plurality of field emission lamps, wherein each one of said plurality of field emission lamps comprises:

a cathode assembly, comprising:

a substrate having a topside and an underside;

an electron emitter deposited on said topside of said substrate;

a first electrically conducting feedthrough passing through said substrate in a manner so that a first end of said first feedthrough is accessible on said topside and a second end of said first feedthrough is accessible on said underside, wherein said first feedthrough is coupled to said electron emitter; and a shelf structure for positioning a grid over said electron emitter.

32. The display as recited in claim 31, further comprising a second electrically conducting feedthrough passing through said substrate and said shelf structure in a manner so that a first end of said second feedthrough is accessible on a topside of said shelf structure and a second end of said second feedthrough is accessible on said underside of said substrate, wherein said second feedthrough couples to said grid.

33. The display as recited in claim 32, further comprising a divider structure for positioning an anode assembly over said electron emitter.

34. The display as recited in claim 33, further comprising a third electrically conducting feedthrough passing through said substrate and said divider structure in a manner so that a first end of said third feedthrough is accessible on a topside of said divider structure and a third end of said third feedthrough is accessible on said underside of said substrate, wherein said third feedthrough couples to said anode assembly.

35. The display as recited in claim 31, further comprising a divider structure for positioning an anode assembly over said electron emitter.

36. The display as recited in claim 35, further comprising a second electrically conducting feedthrough passing through said substrate and said divider structure in a manner so that a first end of said second feedthrough is accessible on a topside of said divider structure and a second end of said second feedthrough is accessible on said underside of said substrate, wherein said second feedthrough couples to said anode assembly.

* * * * *